US006984936B2

(12) United States Patent
Chien et al.

(10) Patent No.: US 6,984,936 B2
(45) Date of Patent: Jan. 10, 2006

(54) PLASMA DISPLAY PANEL AND METHOD OF DRIVING THE SAME

(75) Inventors: Yu-Ting Chien, Yunghe (TW); Shin-Tai Lo, Miaoli (TW)

(73) Assignee: AU Optronics Corp., Hsinchu (TW)

( * ) Notice: Subject to any disclaimer, the term of this patent is extended or adjusted under 35 U.S.C. 154(b) by 111 days.

(21) Appl. No.: 10/226,064

(22) Filed: Aug. 21, 2002

(65) Prior Publication Data

US 2003/0042855 A1 Mar. 6, 2003

(30) Foreign Application Priority Data

Aug. 29, 2001 (TW) ..... 90121277 A

(51) Int. Cl.
*H01J 17/49* (2006.01)

(52) U.S. Cl. ..... 313/586; 313/585; 313/584; 315/169.1

(58) Field of Classification Search ..... 313/582–587; 315/169.1, 169.3, 169.4; 345/60
See application file for complete search history.

(56) References Cited

U.S. PATENT DOCUMENTS 6,479,932 B1 * 11/2002 Nunomura ..... 313/582
6,603,265 B2 * 8/2003 Ahn et al. ..... 313/586
6,741,031 B2 * 5/2004 Harada et al. ..... 313/582

* cited by examiner

*Primary Examiner*—Edward J. Glick
*Assistant Examiner*—Elizabeth Keaney
(74) *Attorney, Agent, or Firm*—Ladas & Parry, LLP

(57) ABSTRACT

A method of driving a plasma display panel to improve display brightness and luminescent efficiency. In the sustain periods, the same driving signal is sent to the sustain electrode X as well as the address electrode Ai at the same time to achieve the desired volume discharge effect. In addition, the structure of PDPs is modified to raise firing voltages between these electrodes, preventing erasure of the data written in the address periods.

5 Claims, 7 Drawing Sheets

PLASMA DISPLAY PANEL AND METHOD OF DRIVING THE SAME

BACKGROUND OF THE INVENTION

1. Field of the Invention

The present invention relates to a plasma display panel (hereafter called PDP) technology, more specifically, to a plasma display panel and a method of driving the plasma display panel to improve the brightness thereof using volume discharge effect.

2. Description of the Prior Art

The PDP is a display device employing charges accumulated by electrode discharge. Due to a variety of advantages, such as large scale, high capacity and full-color capability, the PDP has become one of the most popular flat panels in various applications.

FIG. 1 is a cross-section of the display cell of a conventional triple-electrode PDP. As shown in FIG. 1, the PDP has two glass substrates 1 and 7. Inert gas, such as Ne and Xe, is filled in a cavity between the glass substrates 1 and 7. Two types of electrodes, including sustain electrode X and scan electrodes Yi, are formed on the glass substrate 1 and parallel to each other. In addition, the sustain electrode X and scan electrodes Yi are coated with a dielectric layer 3 and a protective film 5. Address electrodes Ai are formed on the glass substrate 7 and located perpendicular to the sustain electrode X and scan electrodes Yi. Display cells of the PDP are isolated from each other by ribs 8. There are fluorescent materials 9 between these ribs 8 for illuminating in the discharge process. The fluorescent material 9 and the address electrodes Ai are separated by a dielectric layer 4.

FIG. 2 is a top view of the display cell of the conventional PDP. As shown in the figure, the sustain electrode X and the scan electrodes Yi are formed by transparent electrodes and located in parallel on one substrate. Address electrodes Ai are formed on the other substrate, perpendicular to the sustain electrode X and the scan electrodes Yi. The region surrounded by the ribs 8 constitutes a display cell 10.

FIG. 3 is a block diagram of a PDP monitor employing the conventional PDP. As shown in FIG. 3, the PDP 100 is driven by the scan electrodes Y1–Yn and sustain electrode X parallel to each other and the address electrodes A1–Am perpendicular to the electrodes Y1–Yn and X. As well as the PDP, the PDP monitor also includes a control circuit 110, an Y scan driver 112, an X common driver 114 and an address driver 116. The control circuit 110, using clock signal CLOCK, video data signal DATA, vertical synchronizing clock VSYNC and horizontal synchronizing clock HSYNC, produces display data and scan timing information for the generation of the driving signals in the above-mentioned drivers.

FIG. 4 is a timing diagram of the display of a frame on the PDP using the conventional driving scheme. Each frame is divided into several sub-frames. For example, in FIG. 3, each frame is divided into eight sub-frames SF1–SF8. Each sub-frame is used to process a certain gray level in a gray scale for all scanning lines. In a case of the gray scale with 256 gray levels, which corresponds to 8 bits, eight sub-frames are required. In addition, each sub-frame constitutes three operational periods, including reset periods RS1–RS8, address periods AR1–AR8 and sustain periods SS1–SS8.

The reset periods RS1–RS8 clear the residual charges of the last sub-frame. The address periods AR1–AR8 accumulate wall charges on some of the display cells using addressing discharge. More specifically, the scan electrodes Yi are sequentially scanned and address pulses which contain display data are sent to the address electrodes Ai. Thus, the wall charges can be formed on the addressed display cells through the discharge between scan electrodes Yi and address electrodes Ai. The sustain periods SS1–SS8 alternately send sustain pulses to the scanning electrodes Yi and the sustain electrode X. Only the display cells that have had the wall charges generated by addressing discharge in the address periods can be continuously illuminated in the sustain periods.

FIG. 5 is a waveform diagram illustrating the driving signals on the sustain electrode X and scan electrodes Yi of the PDP in a sustain period. As shown in FIG. 5, the X common driver 114 and the Y scan driver 112 alternately send the sustain pulses to the sustain electrode X and the scan electrodes Yi, respectively. If the voltage of the sustain pulses is set to be Vs and the address electrodes Ai are maintained at a constant voltage Vd by means of the electric field between the sustain electrode X and the scan electrode Yi, the display cells that have been written by the data in the address period can continuously illuminate. It is noted that the sustain voltage Vs should be lower than the firing voltage between the sustain electrode X and the scan electrodes Yi, preventing the loss of memory due to unwanted discharge.

The display brightness of the PDP is basically determined by the duration of the sustain periods and the average illumination during the sustain periods. The objective of the present invention is to provide a method of driving the PDP to improve the display brightness and luminescent efficiency of the PDP using the volume discharge effect, upgrading the display performance of the PDP. Conventional proposals for improving the display brightness and luminescent efficiency using the volume discharge effect usually adopt complicated driving schemes, not easily implemented.

SUMMARY OF THE INVENTION

The present invention achieves the above-indicated objects by providing a method of driving a plasma display panel having a sustain electrode and scan electrodes located on the front substrate in parallel and having address electrodes located on the rear substrate. During the sustain periods, a first sustain pulse is transmitted to the sustain electrode and the address electrodes forming positive voltage differences between the sustain electrode and the scan electrodes and between the address electrodes and the scan electrodes. In addition, during the sustain period, a second sustain pulse is alternately transmitted to the scan electrodes for forming negative voltage difference between the sustain electrode and the scan electrodes and between the address electrodes and the scan electrodes. It is noted that the first sustain pulse and the second sustain pulse are square-wave and out of phase. In addition, the maximal voltage of the first sustain pulse and the second sustain pulse is lower than the firing voltages between the sustain electrode and the scan electrodes and between the address electrodes and the scan electrodes, preventing erasure of the written data. Thus, the firing voltages between these electrodes must be high enough to broaden the operational range of the sustain voltage of the sustain pulses. There are four novel structures of the plasma display panel to raise the firing voltage in the present invention.

In the first novel structure, the address electrode is divided into two parts. The first part is located under the rib for partitioning cells and the second part is located just under the sustain electrode and electrically connected to the first part.

In the second novel structure, the address electrode is also divided into two parts. The first part has a first width. The second part has a second width larger than the first width and is located just under the sustain electrode. In the third novel structure, the vertical distance from the sustain electrode to the front substrate is larger than that from the scan electrodes to the front substrate. In the fourth novel structure, an auxiliary address electrode is added on the rear substrate and is electrically connected to the original address electrodes. The auxiliary address electrode is located just under the sustain electrode and parallel to the sustain electrode.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

First Embodiment

The present invention employs the volume discharge effect to improve the display brightness and luminescent efficiency of the PDP during the sustain periods. More specifically, during the sustain periods, as well as the voltage applied between the sustain electrode X and the scan electrode Yi, an auxiliary voltage is additionally applied between the address electrode Ai and the scan electrode Yi. In the present invention, the same driving signal is sent to the sustain electrode X as well as the address electrode Ai at the same time to achieve the desired volume discharge effect.

Figure 1:
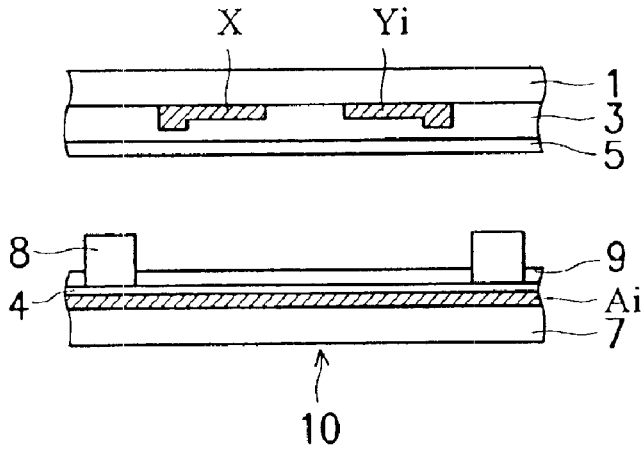
FIG. 1 (PRIOR ART)
FIG. 1 (Prior Art) is a cross-section of A display cell of a conventional triple-electrode PDP.
Figure 2:
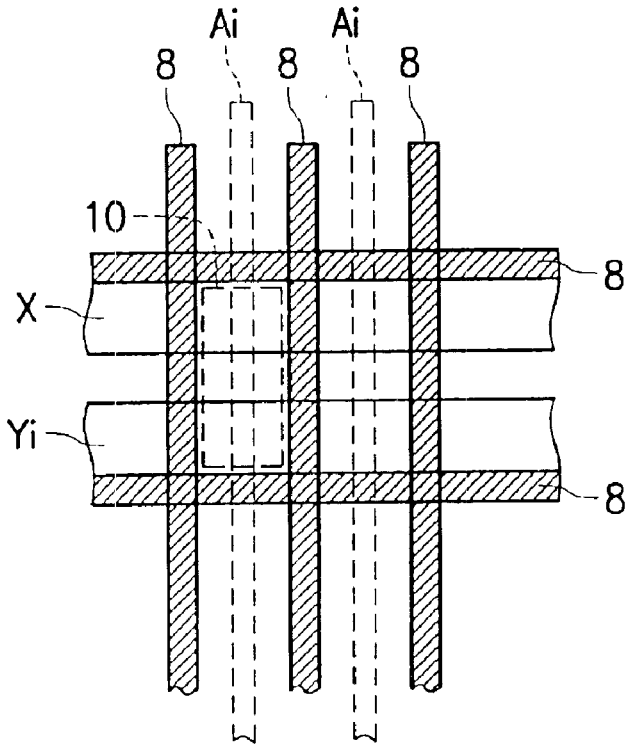
FIG. 2 (PRIOR ART)
FIG. 2 (Prior Art) is a top view of the display cell of the conventional PDP.
Figure 3:
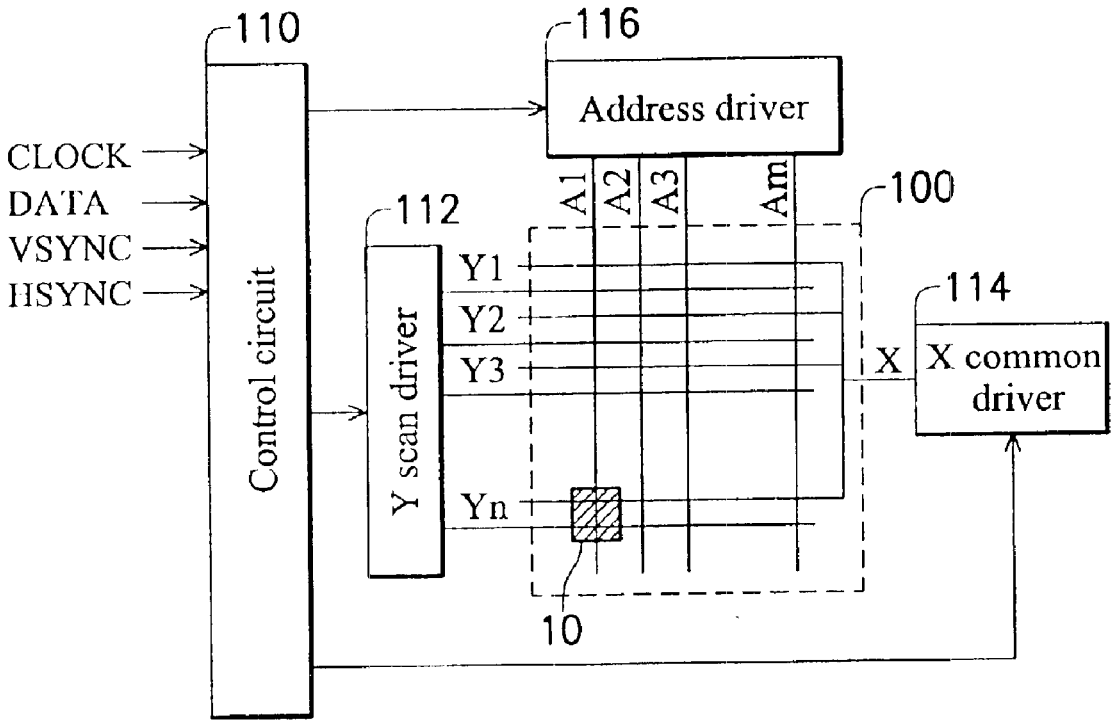
FIG. 3 (PRIOR ART)
FIG. 3 (Prior Art) is a block diagram of a PDP monitor employing the conventional PDP.
Figure 4:
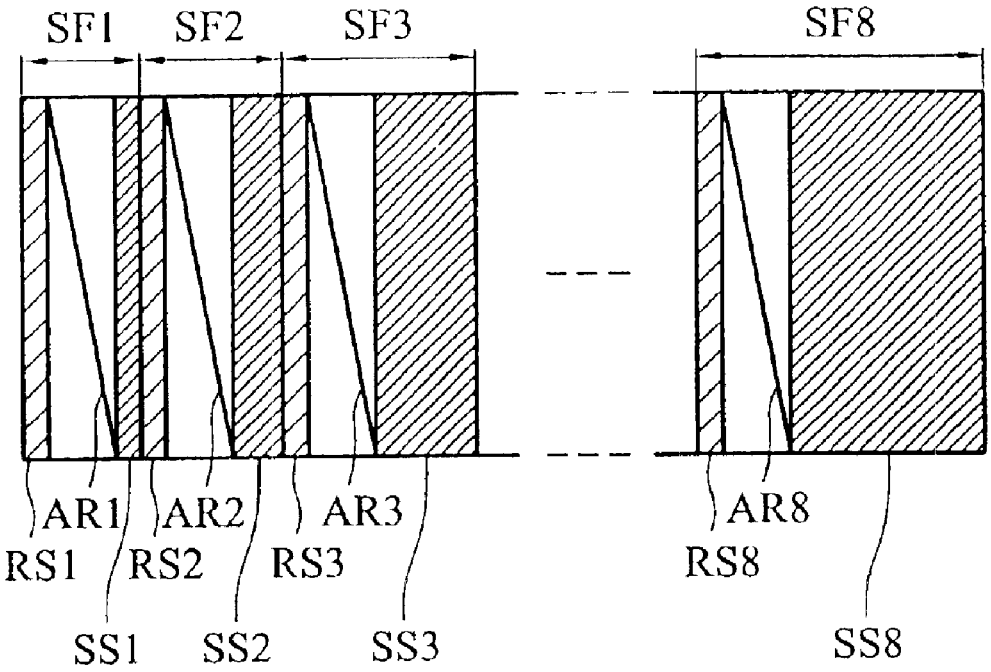
FIG. 4 (PRIOR ART)
FIG. 4 (Prior Art) is a timing diagram of the display of a frame on the PDP using the conventional driving scheme.
Figure 5:
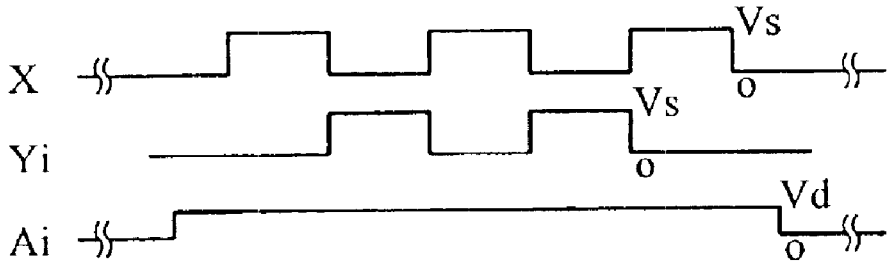
FIG. 5 (PRIOR ART)
FIG. 5 (Prior Art) is a waveform diagram illustrating the driving signals on the sustain electrode X and scan electrodes Yi of the PDP in a sustain period.
Figure 6A:
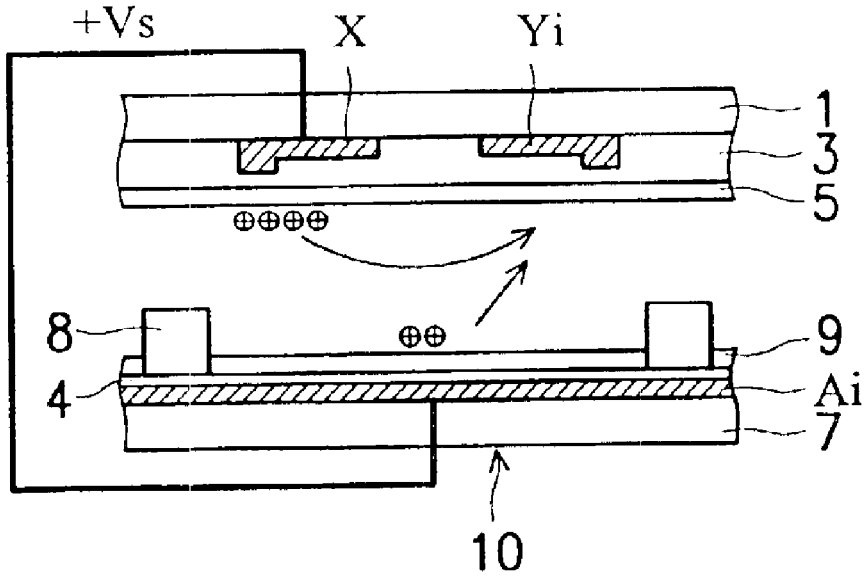
FIGS. 6A and 6B are schematic diagrams illustrating the volume discharge effect in accordance with the present invention.
Figure 6B:
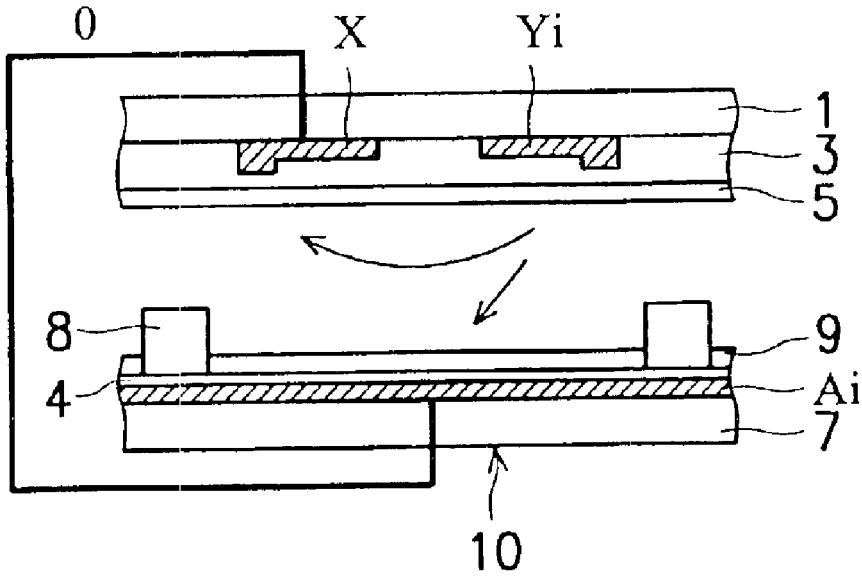

FIGS. 6A and 6B are schematic diagrams illustrating the volume discharge effect in accordance with the present invention. In FIG. 6A, the sustain pulses with an amplitude of voltage Vs are sent to the sustain electrode X and the address electrode Ai, respectively, where the voltage on the scan electrode Yi is 0V. Therefore, the wall charges (i. e. the positive ions) accumulated in the display cell 10 are moving toward the scan electrode Yi. In FIG. 6B, the sustain electrode X and the address electrode Ai are set to be 0V and the scan electrode Yi is set to be the voltage Vs. Now the wall charges move toward the sustain electrode X and the address electrode Ai. Accordingly, during the sustain periods, as well as the electric field between the sustain electrode X and the scan electrode Yi, an auxiliary electric field between the scan electrode Yi and the address electrode Ai occurs to enhance the volume discharge effect, improving display brightness and luminescent efficiency.

Figure 7:
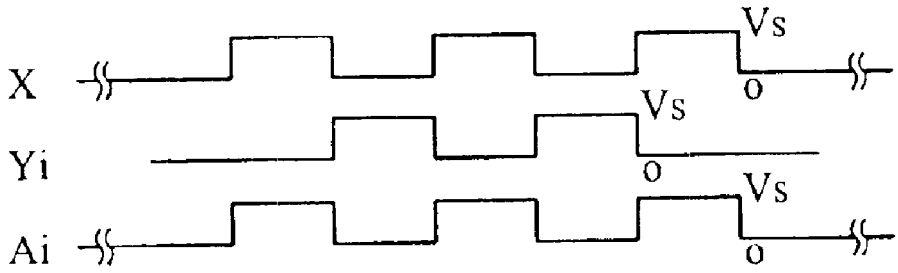
FIG. 7 is a waveform diagram of the driving signals for the sustain electrode X, the scan electrode Yi and the address electrode Ai in accordance with the present embodiment of the present invention.

FIG. 7 is a waveform diagram of the driving signals for the sustain electrode X, the scan electrode Yi and the address electrode Ai in accordance with the present embodiment of the present invention. As shown in FIG. 7, the sustain electrode X and the address electrode Ai are driven to be the same voltage during the sustain period, different from that in the conventional scheme. In other words, the sustain pulses with the amplitude of Vs are alternately sent to electrodes X/Ai and electrode Yi to improve the display brightness and the luminescent efficiency.

In the present invention, the voltage Vs should be set lower than the firing voltage between the scan electrode Yi and the address Ai, preventing accidental erasure of the data written in the address periods. Generally speaking, the firing voltage between the sustain electrode X and the scan electrode Yi is about 190V and the firing voltage between the address electrode Ai and electrodes X/Yi is about 160V. Therefore, the voltage Vs of the sustain pulses is preferably set lower than 160V, preventing erasure of the written data. On the other hand, the voltage Vs of the sustain pulses is preferably high enough to achieve better sustain performance. In other words, the range of effective settings of the sustain voltage Vs is quite narrow. This limitation may not affect the design of smaller PDPs, but deeply influences the design of larger PDPs due to the lack of uniformity in manufacturing processes. To solve such a problem, the firing voltage between the address electrode Ai and the scan electrode Yi should be raised in order to broaden the operational range of the voltage Vs of the sustain pulses. In the present embodiment, a novel structure of the display cell of the PDP is illustrated to achieve the above-mentioned purpose.

Figure 8:
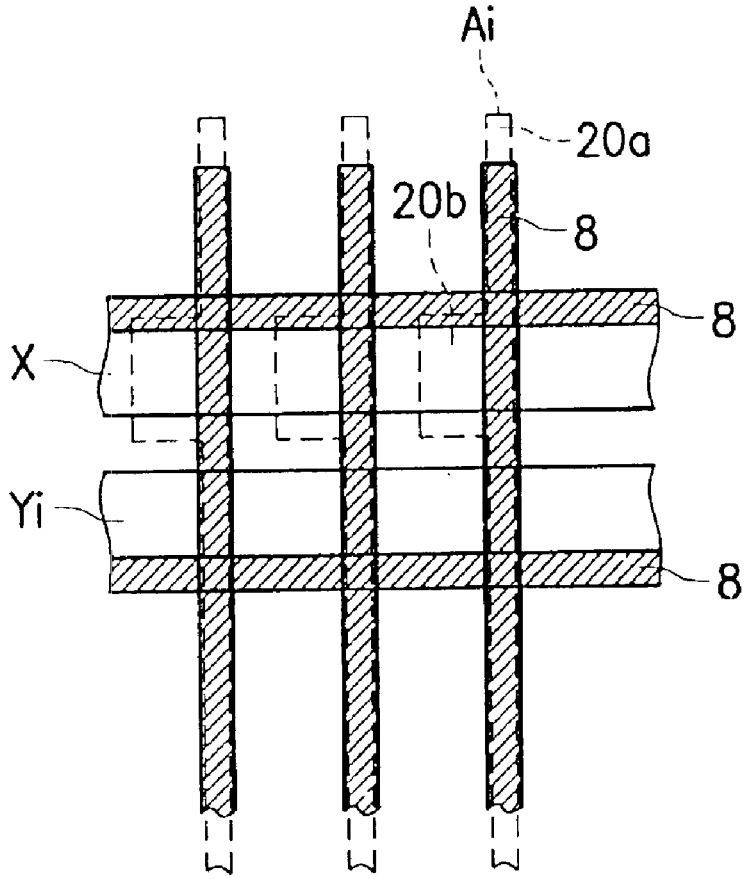
FIG. 8 is a top view of the PDP in accordance with the first embodiment of the present invention.

FIG. 8 is a top view of the PDP in accordance with the first embodiment of the present invention. As shown in FIG. 8, the sustain electrode X and the scan electrodes Yi remain unchanged and the address electrodes Ai are redesigned. Each of the address electrodes Ai is divided into two parts 20*a* and 20*b*. Part 20*a* is a strip located on the rear substrate just under the ribs 8 and its direction is perpendicular to that of the sustain electrode X and the scan electrode Yi. Part 20*b* is electrically connected to part 20*a* and located under the sustain electrode X. Part 20*b* is preferably slightly wider than the sustain electrode X. Parts 20*a* and 20*b* of the address electrode Ai are still on the same plane. The design of the above-mentioned structure adjusts the average distance between the address electrode Ai and the scan electrode Yi. As the average distance is increased, the firing voltage therebetween raises and the operational range of the sustain voltage is thus broadened.

Accordingly, the driving scheme and the novel structure of the PDP do not only improve display brightness and luminescent efficiency using the volume discharge effect, but also broaden the operational range of the sustain voltage to facilitate the design of PDPs.

Second Embodiment

The first embodiment employs the scheme of redesigning address electrodes to raise the firing voltage between the address electrode Ai and the scan electrode Yi and to broaden the operational range of the sustain voltage. The present embodiment adopts a different design to achieve the same object.

Figure 9:
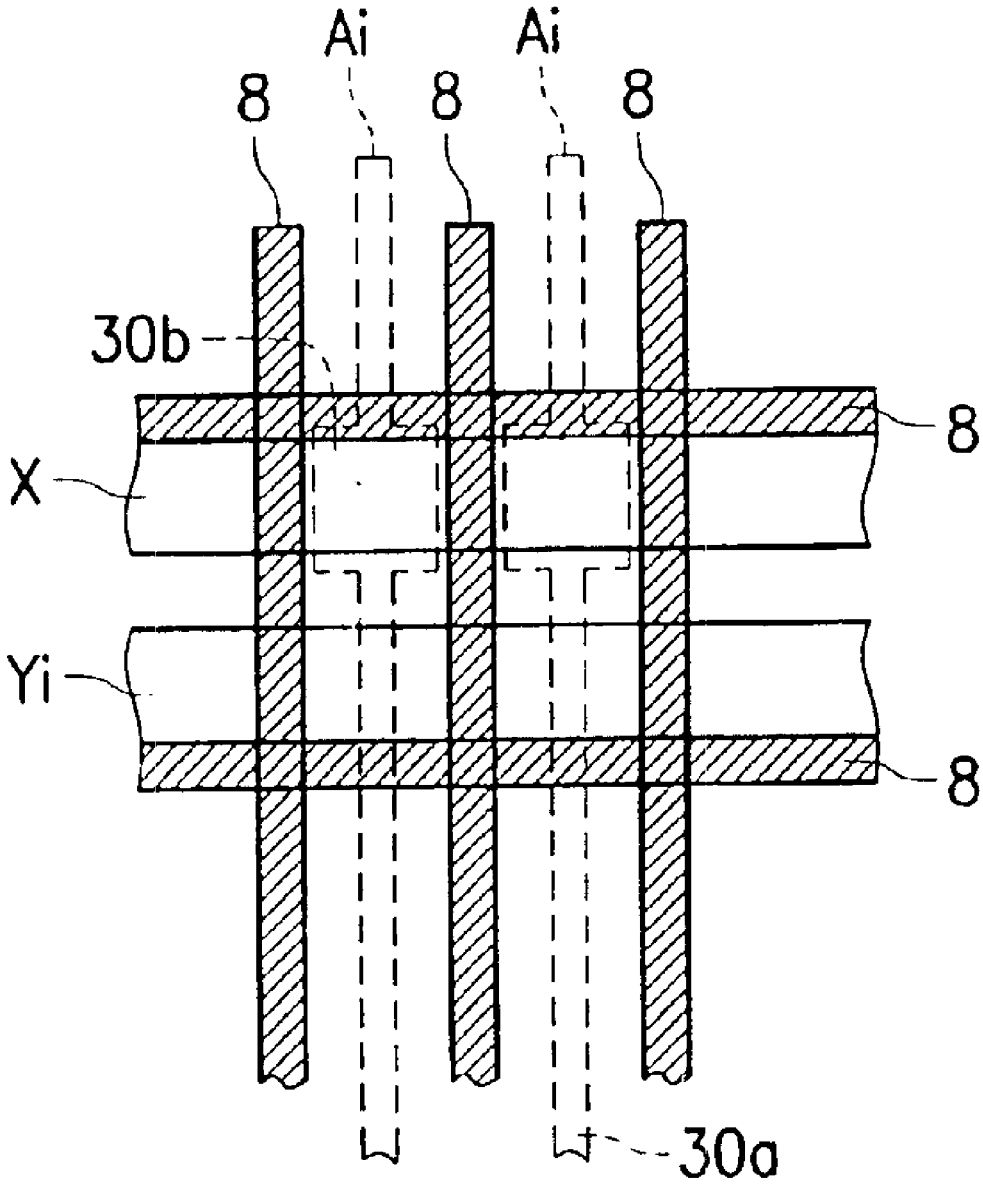
FIG. 9 is a top view of the PDP in accordance with the second embodiment of the present invention.

FIG. 9 is a top view of the PDP in accordance with the second embodiment of the present invention. As shown in FIG. 9, the sustain electrode X and the scan electrodes Yi remain unchanged and the address electrodes Ai are redesigned. In the present embodiment, the address electrode Ai is still located on the rear substrate but divided into two parts with different widths. Part 30*a* is narrower. Part 30*b* is wider and is located just under the sustain electrode X on the front substrate. Conventional address electrodes have a uniform width, about 80~100 μm. In the present embodiment, the width of part 30*a* of the address electrode is about 50 μm and the width of part 30*b* is about 150 μm, where the ratio is preferably about 1:3. The average distance between the address electrode Ai and the scan electrode Yi is increased since the width of the address electrode Ai is not uniform, especially the wider part 30*b* under the sustain electrode X. Thus, the firing voltage therebetween is also raised and the operational range of the sustain voltage is broadened.

Third Embodiment

The first and second embodiments employ the scheme of redesigning the address electrodes to raise the firing voltage between the address electrodes Ai and the scan electrodes Yi. In the present embodiment, the distances between the sustain electrode X and the address electrode Ai and between the scan electrode Yi and the address electrode Ai are altered to adjust the firing voltage.

Figure 10:
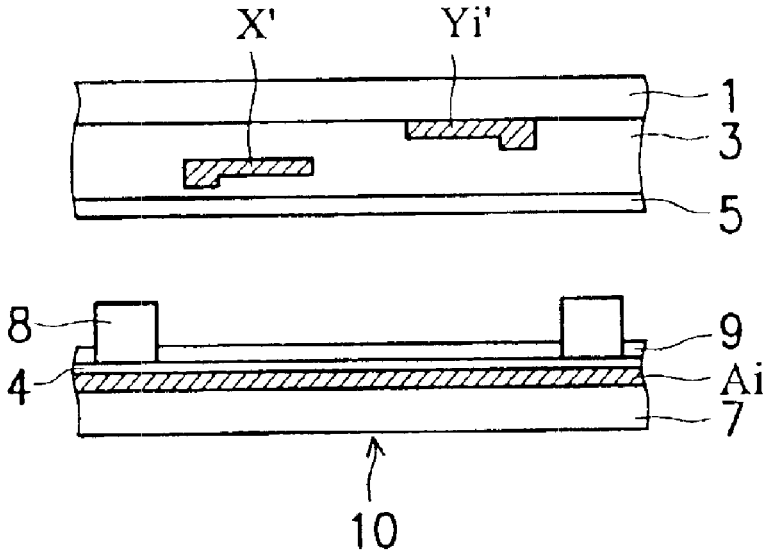
FIG. 10 is a cross-section of the display cell of the PDP in accordance with the third embodiment of the present invention.

FIG. 10 is a cross-section of the display cell of the PDP in accordance with the third embodiment of the present invention. As shown in FIG. 10, the address electrode Ai remains unchanged but the distances between the sustain electrode X' and the address electrode Ai and between the scan electrode Yi' and the address electrode Ai are different. In other words, the sustain electrode X' and the scan electrode Yi' are not located on the same plane. In the present embodiment, the vertical distance from the sustain electrode X' to the substrate 1 is longer than the vertical distance from the scan electrode Yi' to the substrate 1. In other words, the average distance from the address electrode Ai to the scan electrode Yi' is lengthened. Thus, the firing voltage therebetween is raised and the operational range of the sustain voltage is also increased.

Fourth Embodiment

In the present embodiment, an auxiliary address electrode is added to change the firing voltage between the scan electrode Yi and the address electrode Ai, broadening the operational range of the sustain voltage.

Figure 11:
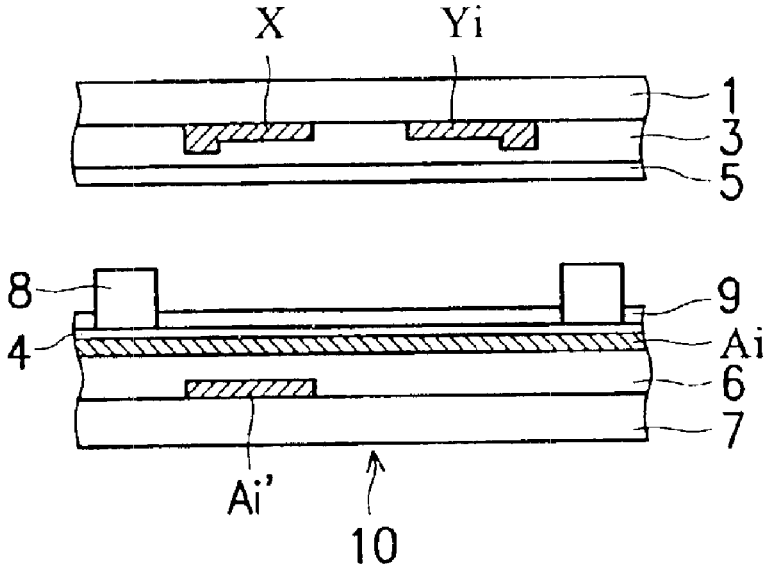
FIG. 11 is a cross-section of a display cell of the PDP in accordance with the fourth embodiment of the present invention.

FIG. 11 is a cross-section of a display cell of the PDP in accordance with the fourth embodiment of the present invention. As shown in FIG. 11, the sustain electrode X, the scan electrode Yi and the address electrode Ai remain unchanged but an auxiliary address electrode Ai' is added and located under the original address electrode Ai. Between the address electrode Ai and the auxiliary address electrode Ai' there is a dielectric layer 6 serving as an isolation. The auxiliary address electrode Ai' is still located on the rear substrate and electrically connected to the original address electrode Ai. In the present embodiment, the auxiliary address electrode Ai' is extended in parallel to the sustain electrode X on the substrate 1 and located just under the sustain electrode X. In other words, the addition of the auxiliary address electrode Ai' increases the firing voltage between the address electrode Ai (including the auxiliary address electrode Ai') and the scan electrode Yi. Thus, the operational range of the sustain voltage is broadened.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A plasma display panel, comprising:

a first substrate;

a second substrate;

a first electrode located on the first substrate and extended in a first direction;

a second electrode located on the first substrate and parallel to the first electrode;

a rib located on the second substrate and extended in a second direction perpendicular to the first direction; and a third electrode located on the second substrate;

wherein the third electrode has a first part located under the rib and only a portion of a second part being located under the first electrode and electrically connected to the first part.

2. The plasma display panel of claim 1, where the second part of the third electrode is wider than the first electrode.

3. A plasma display panel, comprising:

a first substrate;

a second substrate;

a first electrode located on the first substrate and extended in a first direction;

a second electrode located on the first substrate, parallel to and separate from the first electrode; and a third electrode located on the second substrate and extended in a second direction perpendicular to the first direction;

wherein the third electrode has a first part with a first width and a second part with a second width larger than the first width and only a portion of the second part being located under the first electrode.

4. The plasma display panel of claim 3, wherein the ratio of the first width and the second width is about 1:3.

5. A plasma display panel, comprising:

a first substrate;

a second substrate;

a first electrode located on the first substrate and extended in a first direction;

a second electrode located on the first substrate and parallel to the first electrode;

a third electrode located on the second substrate and extended in a second direction perpendicular to the first direction; and an auxiliary electrode located on the second substrate and electrically connected to the third electrode;

wherein the auxiliary electrode is parallel to the first electrode and only a portion of the auxiliary electrode being located under the first electrode.

* * * * *